US006691609B1

(12) United States Patent
Lafaille et al.

(10) Patent No.: US 6,691,609 B1
(45) Date of Patent: Feb. 17, 2004

(54) METHOD AND DEVICE FOR PRINTING OBJECTS

(75) Inventors: Marc Maria Leo Jan Lafaille, Kapellen (BE); Frank François Thijs, Alfaz Del Pi-Alicante (ES)

(73) Assignee: Techi-Coat International (BE)

( * ) Notice: Subject to any disclaimer, the term of this patent is extended or adjusted under 35 U.S.C. 154(b) by 0 days.

(21) Appl. No.: 09/926,292

(22) PCT Filed: Apr. 4, 2000

(86) PCT No.: PCT/BE00/00029

§ 371 (c)(1),
(2), (4) Date: Oct. 9, 2001

(87) PCT Pub. No.: WO00/61376

PCT Pub. Date: Oct. 19, 2000

(30) Foreign Application Priority Data

Apr. 7, 1999 (BE) ..... 9900237

(51) Int. Cl.[7] ..... B41J 17/00

(52) U.S. Cl. ..... 101/93; 101/33; 101/34; 101/35; 101/41

(58) Field of Search ..... 101/35, 41, 33, 101/34, 93

(56) References Cited

U.S. PATENT DOCUMENTS 4,098,184 A * 7/1978 Okada et al. ..... 101/41
4,281,618 A * 8/1981 Fenimore ..... 118/202
4,508,032 A * 4/1985 Philipp ..... 101/163
4,664,672 A * 5/1987 Krajec et al. ..... 8/472
5,641,372 A * 6/1997 Okuno ..... 156/230
6,092,578 A * 7/2000 Machida et al. ..... 156/358
6,158,341 A * 12/2000 Holmberg ..... 101/170
6,234,079 B1 * 5/2001 Chertkow ..... 101/395

FOREIGN PATENT DOCUMENTS

DE 3244355 A1 * 6/1984 ..... B41M/5/26
DE 3310432 A1 * 9/1984 ..... B41M/1/30
JP 57051488 A * 3/1982 ..... B41M/3/12
JP 11010997 A * 1/1999 ..... B41M/1/40

* cited by examiner

*Primary Examiner*—Andrew H. Hirshfeld
*Assistant Examiner*—Andrea H. Evans
(74) *Attorney, Agent, or Firm*—Bacon & Thomas, PLLC

(57) ABSTRACT

A method for printing an image onto an object including applying printing ink to a carrier element constructed of a flexible layer-shaped material and in communication with a pressing device having an internal region which can be pressurized with a fluid, positioning the carrier element and the object in contact with one another without substantially increasing the internal pressure of the pressing device and then causing a substantial increase of pressure in the internal region of the pressing device whereby a portion of the carrier element is urged to further extend around the object. The carrier element is stretched at least during the step of applying the printing ink.

20 Claims, 4 Drawing Sheets

METHOD AND DEVICE FOR PRINTING OBJECTS

This invention relates to a method and a device for printing objects, more particularly for printing the surface of three-dimensional objects.

A practical application intended by the invention is the application of a decorative coating on the casing of portable telephones, in particular on the front side of GSM devices. It is known that the front side of such devices comprises inwardly-directed parts, such as, for example, the seats of the push-buttons. Generally, these front sides are provided with a colour or ink coating by means of a paint spraying technique. A disadvantage of this technique consists in that it is difficult to provide the inward-bent parts with ink and/or colour. This becomes even more difficult when the coating must not consist of only one and the same colour layer and, for example, it is desired to form images on the front side, as then it is necessary to work with masks. Another disadvantage consists in that this technique is little environment-friendly, as a large part of the colour or ink will get beside the object.

The present invention in the first place aims at a method and a device which are particularly suited for printing three-dimensional objects. More particularly, it aims at a technique whereby the aforementioned disadvantages when printing the front side of GSM devices and similar, are excluded.

To this aim, the invention concerns a method for printing objects, with as a characteristic that it at least consists in, on one hand, the application of printing ink on a carrier consisting of a flexible layer-shaped material and, on the other hand, transferring the printing ink to the object to be printed, by bringing said carrier and the object into mutual contact and by pressing-on said carrier, by means of supplementary pressing means, at least partially around the object to be printed.

By using a flexible carrier, it is obtained that the carrier easily can assume the shape of the surface to be printed and, by moreover applying supplementary pressing means therewith, a complete pressing-on can be guaranteed.

Preferably, for the supplementary pressing means use is made of a fluid pressure, more particularly air pressure, with which a pressure is exerted on the side of the carrier which is opposite to the side which is brought into contact with the object to be printed.

According to another possibility, supplementary pressing means of mechanical nature are applied, such as a counterform of the object to be printed, with which the carrier can be pressed against the object.

In the most preferred form of embodiment, the aforementioned two kinds of pressing means will be combined, which, in the first place, is useful when printing the front side of a portable telephone. By this combination, it is achieved that the carrier can be pressed into small, relatively deep indentations by means of the counterform, whereas by the pressing, realized by means of the compressed air, on one hand, always a perfect pressing over the entire surface to be printed is guaranteed, whereas, on the other hand, also the bent lateral edges of the object can be printed which are difficult to reach by means of a counterform.

In a preferred form of embodiment, the image to be printed is applied on the carrier in two-dimensional condition and then, by deformation of the carrier, printed on the object in three-dimensional condition. This technique allows for that the application of the image which can consist of a figure as well as of an even coating of one and the same colour or similar, can easily be realized.

In a practical form of embodiment, the carrier will be stretched at least during the application of the printing ink, in such a manner that during the application a flat substructure is offered. According to a variant, however, it is not excluded to provide a support surface under this carrier during the application of the printing ink, whether or not combined with the stretching of the carrier.

Preferably, the carrier will also be stretched during the actual printing, for example, by pressing the object to be printed over a well-defined distance into the plane of the carrier.

More particularly, it is preferred that the carrier during the application of the printing ink and the actual printing is stretched in opposite direction, whereby it is displaced over approximately the same distance, and even better is displaced in such a manner that approximately the same extension at the location of the printed image takes place, with the advantage that there is almost no size difference between the image applied on the carrier and the printed image.

Practically, a carrier will be applied showing a contact surface consisting of a colour- or ink-repellent material. According to a particular characteristic of the invention, to this aim use will be made of a silicone mat or a flexible layer of material based on silicones. Such material offers the advantage that it is very flexible and at the same time will easily release the printing ink during printing.

According to a particular aspect of the invention, the printing ink is provided on the support by means of a printer. As a result of this, forming different images and rapidly switching over from one image to the other is rendered very easy, simply by controlling the printer.

The invention also relates to a device for realizing the aforementioned method, with as a characteristic that it at least consists of a carrier of a flexible layer-shaped material; means for applying printing ink on the carrier; means for transferring the printing ink to the object to be printed, said means consisting of a displacement mechanism for bringing said carrier and the object into mutual contact; and supplementary pressing means which cooperate with the carrier and allow to press on the latter, at least partially around the object to be printed.

With the intention of better showing the characteristics according to the invention, hereafter, as an example without any limitative character, a preferred form of embodiment is described, with reference to the accompanying drawings, wherein:

FIG. 1 schematically represents a device according to the invention;

Figure 4:
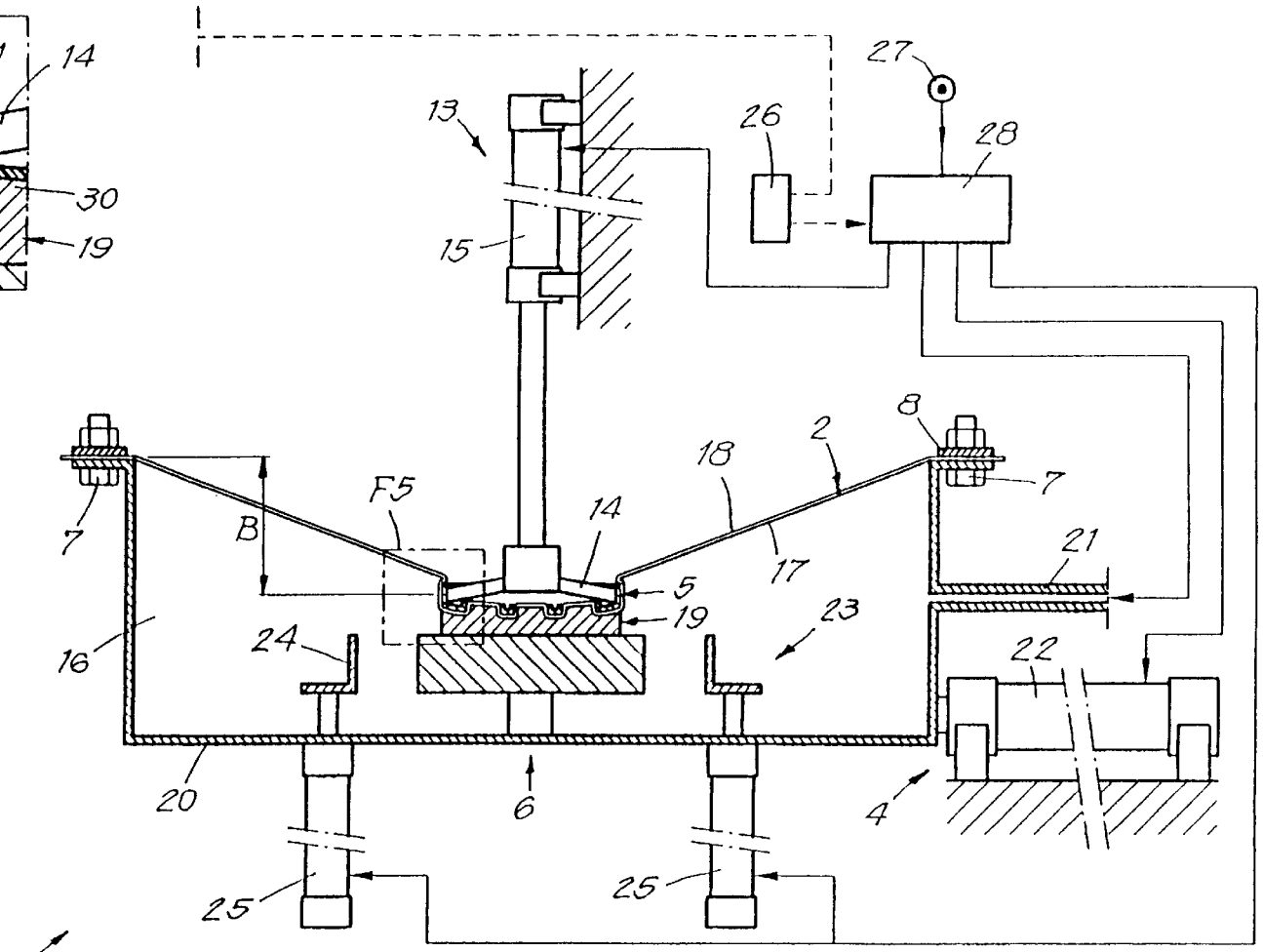
Figure 5:
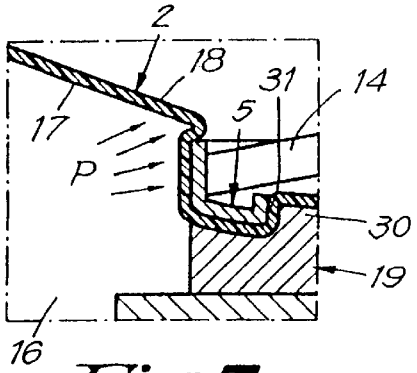

FIG. 5, at a larger scale, represents the part indicated by F5 in FIG. 4.

As represented in the figures, the device 1 of the invention substantially consists of a carrier element 2 of a flexible layer-shaped material; printing device or means 3 for applying printing ink on the carrier 2; transfer device or means 4 for transferring the printing ink to the object 5 to be printed, in this case the front part of a GSM device; and supplementary pressing device or means 6 which cooperate with the carrier 2 and allow to press on the latter, at least partially around the object 5 to be printed.

Figure 1:
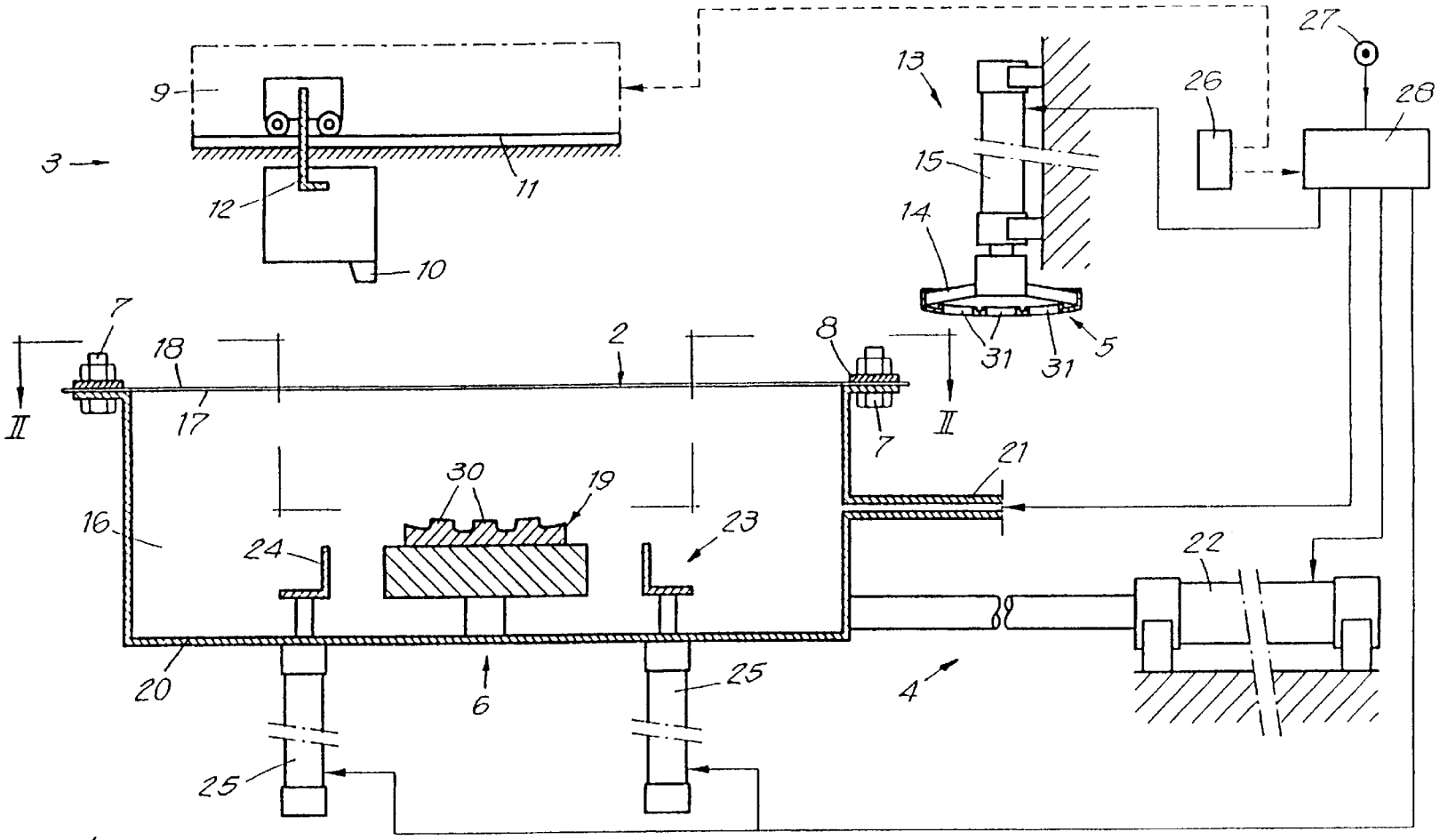

The carrier 2 consists of a colour- or ink-repellent material, more particularly a mat which is held at its circumference, in this case by being clamped at its circumference, by means of bolts 7, in a framing 8. In the example, the carrier 2 in the condition of FIG. 1 is not or almost not stretched.

According to the invention, this carrier 2 preferably consists of a silicone mat. Particularly good results can be obtained with a mat having, in un-stretched condition, a thickness of 1 to 3 mm, and preferably 2 mm.

The means 3 for applying the printing ink on the carrier 2 substantially consist of a printer 9 which can be controlled in a suitable manner, either by means of a suitable software package, or by means of a not represented computer unit.

This printer 9, in its turn, can show a classic construction and substantially consists of a printing head 10, with which preferably several colours can be printed, and driving means for moving the printing head 10, on one hand, along one or more longitudinal guides 11 and, on the other hand, one or more transversal guides 12.

Further, the device 1 comprises positioning device or means 13 for presenting the object to be printed which, in the represented example, consist of a holder 14 with which the object 5 is held, and a driving cylinder 15 for moving the holder 14 up and down. According to a not represented variant, these means 13 may also consist of a robot arm which takes up the objects 5 to be printed one after the other and presents them to the device 1.

The means 4 for transferring the printing ink to the object to be printed, form a part of displacement means which allow to move the carrier 2 and/or the means 3 and/or the means 13 in respect to each other, in order to bring them, on one hand, into a first position, whereby the carrier 2 cooperates with the means 3 for applying the printing ink, and, on the other hand, into a second position whereby the carrier 2 cooperates with the object 5, in such a manner as will be further explained in the following.

Said supplementary pressing means 6 consist in the represented example of a pressure chamber 16, more particularly a compressed air chamber, which cooperates with the side 17 of the carrier 2 which is opposite to the side 18 which is brought into contact with the object 5 to be printed, as well as of a counterform 19 with which the carrier 2 can be pressed against the object 5 to be printed or at least is forced to take the the shape of the object 5 to be printed to a minor or major extent.

The pressure chamber 16 consists of a casing 20 which is closed off at the upper side by means of the carrier 2. This casing 20, by means of a conduit 21, can be set under pressure, depressurized, respectively. In the represented example, the counterform 19 is mounted fixedly in the pressure chamber 16.

Figure 2:
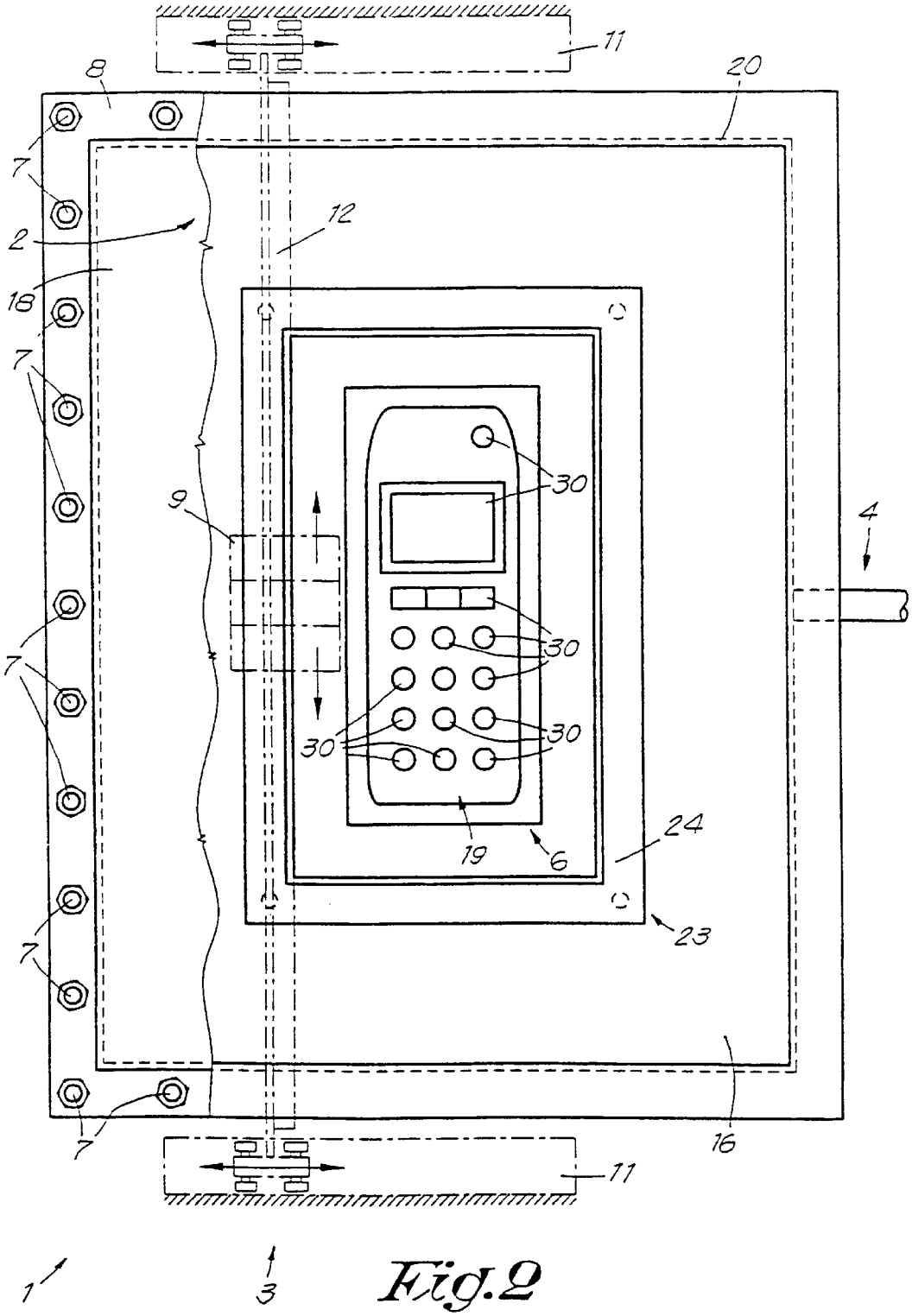
FIG. 2 represents a cross-section according to line II—II in FIG. 1.
Figure 3:
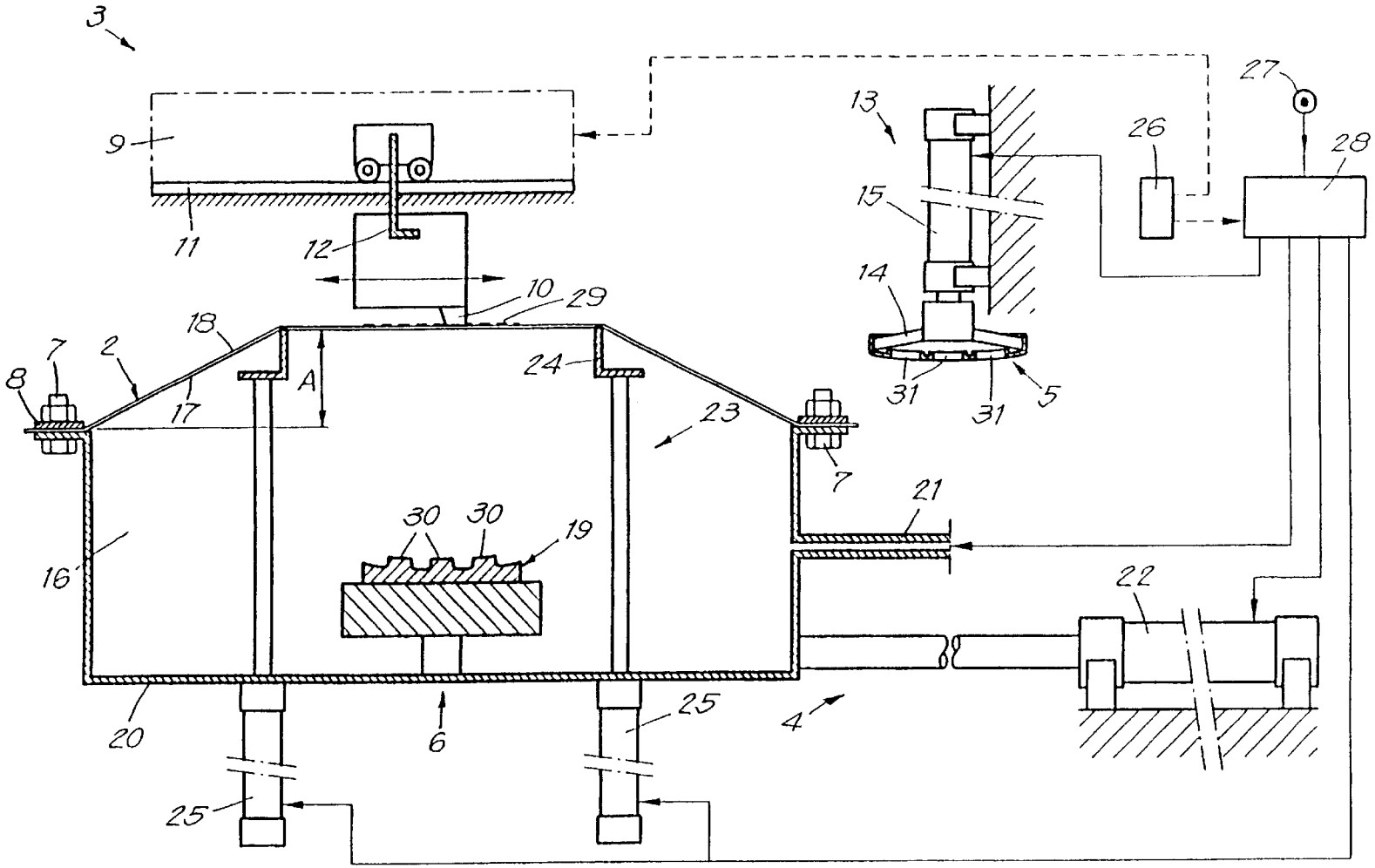
FIGS. 3 and 4 represent the device of FIG. 1 in two other positions.

In the represented example, said displacement means comprise, on one hand, the already mentioned driving cylinder 15 for displacing an object 5 carried thereby and, on the other hand, a driving cylinder 22 for displacing the pressure chamber 16 between a position under the printer 9, as represented in FIGS. 1 to 3, and a position under the driving cylinder 15, as represented in FIG. 4.

The device is also provided with a stretching device or means 23 for stretching the carrier 2 during the application of the printing ink on this carrier 2, consisting of a frame 24 in the shape of a rectangular framing, which can cooperate with the underside of the carrier 2, more particularly can be moved up and down between a position whereby the frame 24, as represented in FIG. 1, is located freely under the carrier 2, and a position whereby the frame 24, as represented in FIG. 3, is moved upward, as a result of which the carrier 2 is stretched and tensioned. The movement of the frame 24 is performed by means of driving cylinders 25.

The whole is controlled by means of a control unit 26 which may consist of a computer or similar. The driving cylinders 15, 22, and 25 are fed by means of a compressed air supply 27 and are controlled by means of valves 28 which, in a suitable manner, according to the working cycle explained in the following, are actuated by means of the control unit 26.

FIG. 1 shows the non-operated condition. From this non-operated condition, the driving cylinders 25 are actuated, as a result of which the frame 24 is brought up into the position of FIG. 3 which is such that the carrier 2 then is positioned precisely under the printing head 10, in stretched condition.

Subsequently, the printer 9 is controlled, in such a manner that printing ink 29 is deposited on the carrier 2, whereby the image to be printed is formed. Hereby, this may either relate to an image representing a picture, or to an image simply consisting of a quantity of printing ink of the same colour, preferably in the shape of the object 5 to be printed.

It is noted that the term printing ink has to be interpreted broadly and that, according to the invention, any material has to be subsumed thereunder with which a coating can be realized, thus, an actual ink as well as a paint, varnish or any other material.

After the image has been formed on the carrier 2, the frame 24 is lowered again and the pressure chamber 16 is moved up into a position whereby this latter is positioned with the counterform 19 under the object 5. By subsequently moving the object 5 downward, by means of the driving cylinder 15, and pressing it against the counterform 19 and also feeding compressed air into the pressure chamber 16, a condition is obtained as represented in FIGS. 4 and 5. In this condition, the carrier 2, on one hand, due to the presence of the counterform 19, and, on the other hand, due to the pressure P in the pressure chamber 16, perfectly fits against the object 5 to be printed, as a result of which the printing ink 29 of the image is adequately transferred to the object 5. The protrusions 30 of the counterform 19 hereby penetrate into the seats 31 for the telephone push-buttons.

For pressing-on the carrier 2, in the pressure chamber 16 preferably only a rather low pressure is applied, of less than 100 and even better of 50 to 60 gram/cm$^2$.

Finally, the object 5 can be moved upward again and subsequently be transported off, after which the cycle can be repeated with a successive object 5.

It is noted that the distance A over which the carrier 2 is moved in FIG. 3 preferably almost coincides with the distance B over which this carrier 2 is moved in FIG. 4, in such a manner that an almost equal extension of the material of the carrier 2 at the location of the object 5 is obtained.

Possibly, the device 1 can be equipped with a cleaning mechanism, which may or may not work automatically, in order to remove inconvenient ink remainders from the carrier 2.

It is obvious that different variants are possible. So, for example, instead of attaching the framing 8 by means of bolts 7, this framing 8 can be equipped with an easy to handle stretching mechanism.

The movement cycle also does not necessarily have to be performed precisely such as represented in the figures. So, for example, it is not excluded to mount the pressure chamber 16 in a fixed manner and to install the means 13 above the printer 9, whereby the printing head 10 is moved sidewards at the moment when the object 5 is brought into contact with the carrier 2.

According to a particular variant, the counterform 19 is positioned precisely under the carrier 2, whereby this is possible for the position of FIG. 1 as well as for the one of FIG. 3.

It is noted that the invention also relates to methods and devices whereby for the supplementary pressing means, either use is made exclusively of fluid pressure, or use is made exclusively of mechanical pressing means. It is also not excluded to use a liquid for the fluid pressure instead of a gas.

The present invention is in no way limited to the form of embodiment described by way of example and represented in the figures, on the contrary may such method and device for printing objects be realized according to different variants, without leaving the scope of the invention.

What is claimed is:

1. A method for printing an image onto an object, the method comprising the steps of:

applying printing ink to a carrier element constructed of a flexible layer-shaped material and in communication with a pressing device having an internal region which can be pressurized with a fluid;

positioning the carrier element and the object in contact with one another without substantially increasing the internal pressure of the pressing device; and then causing a substantial increase of pressure in the internal region of the pressing device whereby a portion of the carrier element is urged to further extend around the object;

wherein the carrier element is stretched at least during the step of applying the printing ink.

2. The method according to claim 1, wherein the internal region is pressurized with air, the pressure of the internal region exerting upon a lower side of the carrier element opposite to an upper side of the carrier element brought into contact with the object.

3. The method according to claim 2, wherein the air pressure in the internal region is within the range of 50 to 60grams/cm$^2$.

4. The method according to claim 1, further comprising the step of applying mechanical elements to the object, the mechanical elements cooperating with the pressing device.

5. The method according to claim 4, wherein the mechanical elements include a counterform of the object.

6. The method according to claim 1, wherein the image to be printed onto the object is applied on the carrier element in a two-dimensional state, the carrier element being deformed around the object in a three-dimensional condition to impart the image thereon.

7. The method according to claim 1, wherein the carrier element is stretched at least during the step of printing the ink onto the object.

8. The method according to claim 7, wherein the carrier element is stretched when the object is urged a predetermined distance into the carrier element.

9. The method according to claim 1, wherein the carrier element is outwardly stretched a predetermined distance relative to the pressing device when the printing ink is applied thereon, the outwardly stretched distance of the carrier element is about a distance the object is urged towards and into the carrier element when the image is printed onto the object.

10. The method according to claim 1, wherein the carrier element is provided with a contact surface consisting of a color- or ink-repellent material.

11. The method according to claim 10, wherein the carrier element is a silicone mat.

12. The method according to claim 1, wherein the printing ink is applied on the carrier element by a printing device.

13. The method according to claim 1, wherein the object is a casing for portable telephones.

14. An apparatus for printing an image onto an object, the apparatus comprising:

a carrier element of a flexible layer-shaped material having opposed first and second sides;

a printing device configured to apply printing ink on the first side of the carrier;

a transfer device configured to position the carrier element relative to the object;

a pressing device in communication with the carrier element and arranged to exert pressure onto the carrier element, said pressing device having an internal region pressurized with a fluid and cooperating with the second side of the carrier element to thereby cause a portion of the carrier element to extend around the object when the object is urged towards and into the first side of the carrier element; and a stretching device arranged to stretch the carrier element during the application of the printing ink thereon, said stretching device including a frame arranged to cooperate with the carrier element and which is displaceable relative to said carrier.

15. The device according to claim 14, wherein the carrier element is a color- or ink repellent mat secured at its circumference.

16. The device according to claim 14, wherein the pressing device includes a counterform element arranged for the object and the carrier element to be urged thereagainst.

17. The device according to claim 14, wherein the counterform element is located within the internal region of the pressing device.

18. The device according to claim 14, wherein the printing device is movable over and laterally relative to the carrier.

19. The device according to claim 14, further comprising:

a positioning device arranged to position the object relative to the carrier element;

wherein the transfer device is configured to position the carrier element between the printing device and the positioning device.

20. A method for printing an image onto an object, the method comprising the steps of:

applying printing ink to a carrier element constructed of a flexible layer-shaped material, said carrier element being stretched when the printing ink is applied thereon;

positioning the carrier element and the object in contact with one another; and urging the object and the carrier element further in contact with each other by a pressing device, thereby causing a portion of the carrier element to further extend around the object.

* * * * *

UNITED STATES PATENT AND TRADEMARK OFFICE

CERTIFICATE OF CORRECTION

PATENT NO. : 6,691,609 B1
DATED : February 17, 2004
INVENTOR(S) : Lafaille et al.

It is certified that error appears in the above-identified patent and that said Letters Patent is hereby corrected as shown below:

Title page,
Item [73], Assignee, should read:
-- Techni-Coat International Naamloze Vennootschap --

Signed and Sealed this

Fifteenth Day of June, 2004

JON W. DUDAS
*Acting Director of the United States Patent and Trademark Office*